US006202382B1

(12) United States Patent
Conterno

(10) Patent No.: US 6,202,382 B1
(45) Date of Patent: Mar. 20, 2001

(54) RELATING TO PANEL COUPLING ASSEMBLIES

(75) Inventor: Cosimo Conterno, Mendrisio (CH)

(73) Assignee: Politec Polimeri Tecnici S.A., Stabio (CH)

( * ) Notice: Subject to any disclaimer, the term of this patent is extended or adjusted under 35 U.S.C. 154(b) by 0 days.

(21) Appl. No.: 09/238,637

(22) Filed: Jan. 28, 1999

(30) Foreign Application Priority Data

| | | |
|---|---|---|
| Jan. 29, 1998 | (CH) | 19980215/98 |
| Mar. 2, 1998 | (GB) | 9804188 |
| Mar. 12, 1998 | (CH) | 19980597/98 |

(51) Int. Cl.[7] ..... E04B 2/00

(52) U.S. Cl. ..... 52/762; 52/775; 52/464; 52/468; 52/235; 52/241; 52/281; 52/582.1

(58) Field of Search ..... 52/762, 14, 464, 52/465, 468, 775, 772, 774, 235, 241, 281, 731.5, 733.2, 737.6

(56) References Cited

U.S. PATENT DOCUMENTS

| | | | | |
|---|---|---|---|---|
| 3,367,077 | * | 2/1968 | Johnston | 52/464 |
| 4,850,167 | * | 7/1989 | Beard et al. | 52/200 |
| 4,891,920 | * | 1/1990 | Pingston | 52/145 |
| 4,996,809 | * | 3/1991 | Beard | 52/200 |
| 5,580,620 | | 12/1996 | Campbell et al. | 428/34 |
| 6,016,632 | * | 1/2000 | McGee et al. | 52/241 |

FOREIGN PATENT DOCUMENTS

| | | |
|---|---|---|
| 0816585A2 | 1/1998 | (EP) . |
| 0835968A2 | 4/1998 | (EP) . |
| 0864708a2 | 9/1998 | (EP) . |
| 2291456 | 1/1996 | (GB) . |

* cited by examiner

*Primary Examiner*—Christopher T. Kent
*Assistant Examiner*—Jennifer I. Thissell
(74) *Attorney, Agent, or Firm*—Jacobson, Price, Holman & Stern, PLLC

(57) ABSTRACT

Two generally co-planar panels (4) are supported almost edge-to-edge by an intermediate beam (1). A coupling member (2) is captive to the beam (1) by interengaging longitudinal formations (6, 11) and provides an interlocking engagement (12, 18) for the edges of the panels (4). Opposite the coupling member (2) the beam (1) is proud of the panels (4) and receives and retains a cap (3) which seals against the panels (4).

14 Claims, 3 Drawing Sheets

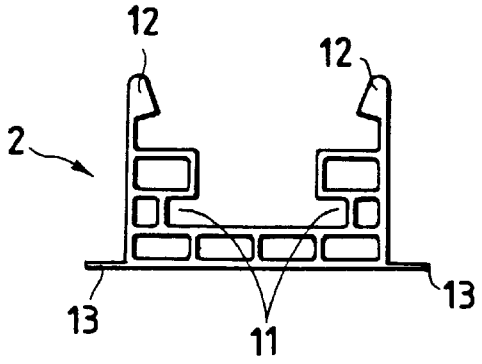
Fig.3
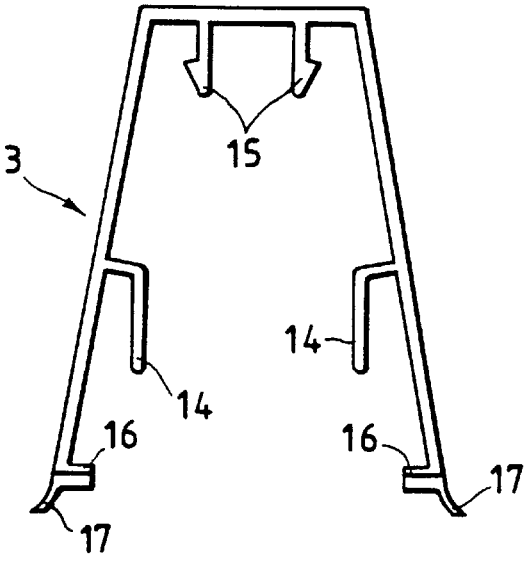
Fig.4
Fig.5
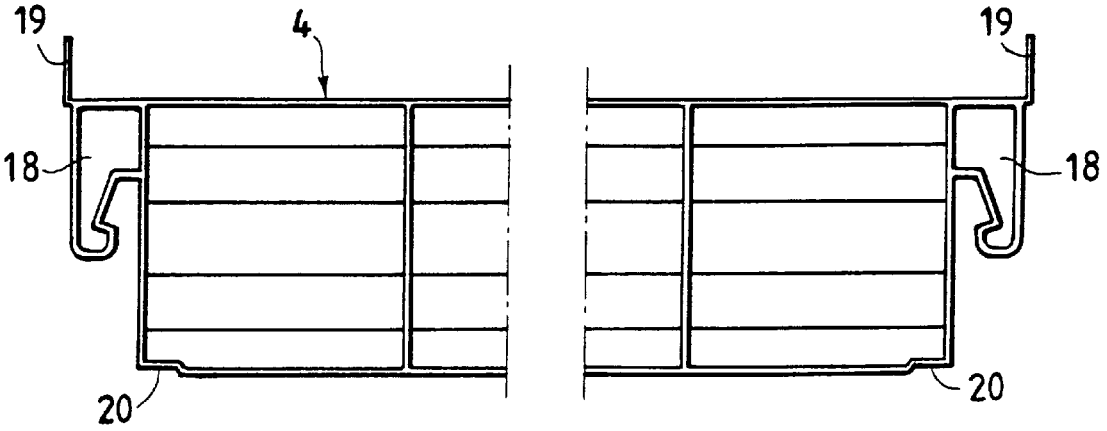

RELATING TO PANEL COUPLING ASSEMBLIES

This invention relates to panel coupling assemblies. It is particularly concerned with roofs, such as those of conservatories, having transparent or translucent panels supported side by side by beams. These beams are generally part of the framework of the structure. There are various requirements for such assemblies, and in particular the panels must be held securely and the joints must be waterproof. There should also be high degrees of thermal and acoustic insulation. At the same time assembly should be simple, and preferably be achievable by one person working alone.

According to the present invention there is provided a coupling assembly for two substantially co-planar panels, the assembly comprising a beam, a coupling member and a cap, the coupling member being engageable with a first longitudinal portion of the beam to be retained thereby, the adjacent edges of the panels having formations engageable with the coupling member to be retained thereby on opposite sides of the beam, and the cap being engageable with a second longitudinal portion of the beam, proud of the panels, to cover said second portion and the edge formations.

The first longitudinal portion of the beam conveniently has lateral flanges or ribs which engage in complementary grooves of the coupling member, while the edge formations of the panels preferably interhook with edge portions of that member. The coupling member may thus be channel shaped with the grooves at the base of the channel terminating in hooked edge formations. Preferably the interhooking of the panel edge portions with the coupling member is by snap action.

In a roof structure the first longitudinal portion of the beam will be underneath, but it will be concealed from view below by the coupling member, which can provide the insulation referred to above.

Generally, sealing means will be interposed between the panels and the edges of the cap that co-operate with the panels.

Both the panels and the coupling member are preferably multiwall extrusions of synthetic resin such as polycarbonate. The cap may be an extrusion of solid resin, such as PVC, while the beam will normally be of metal, such as an aluminum extrusion.

Figure 1:
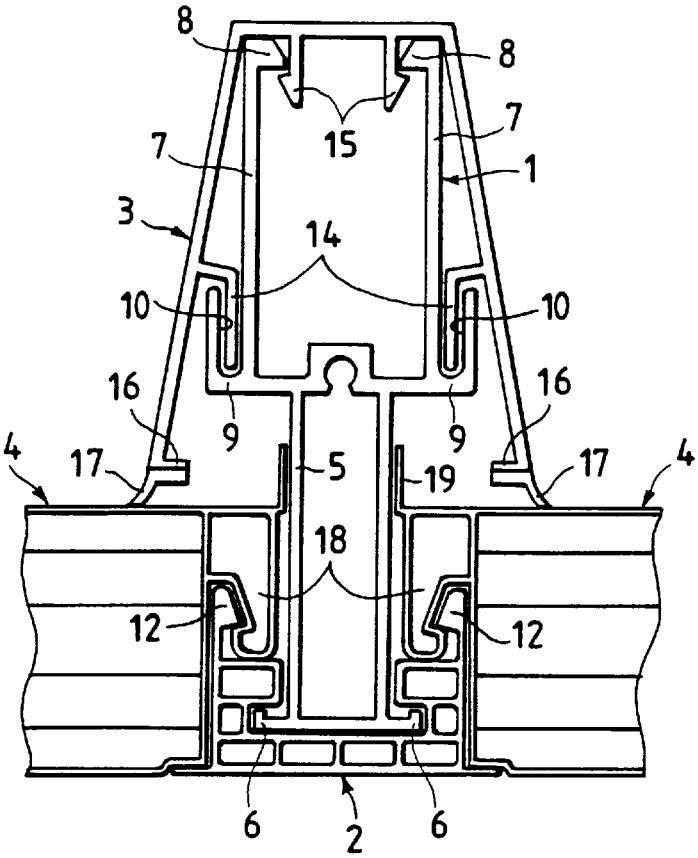
Figure 2:
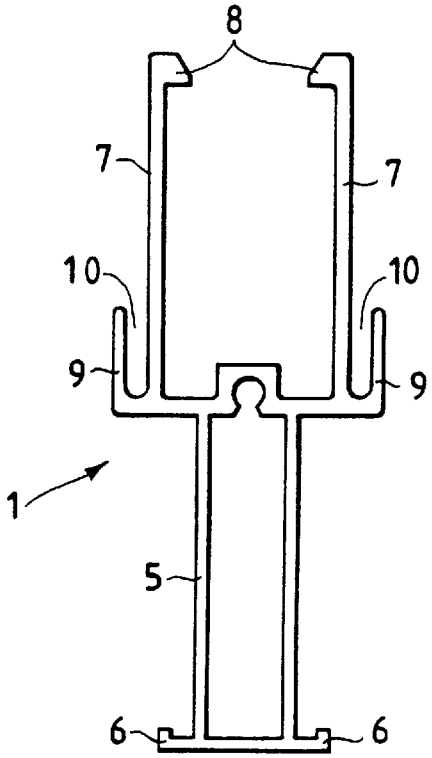
Figure 6:
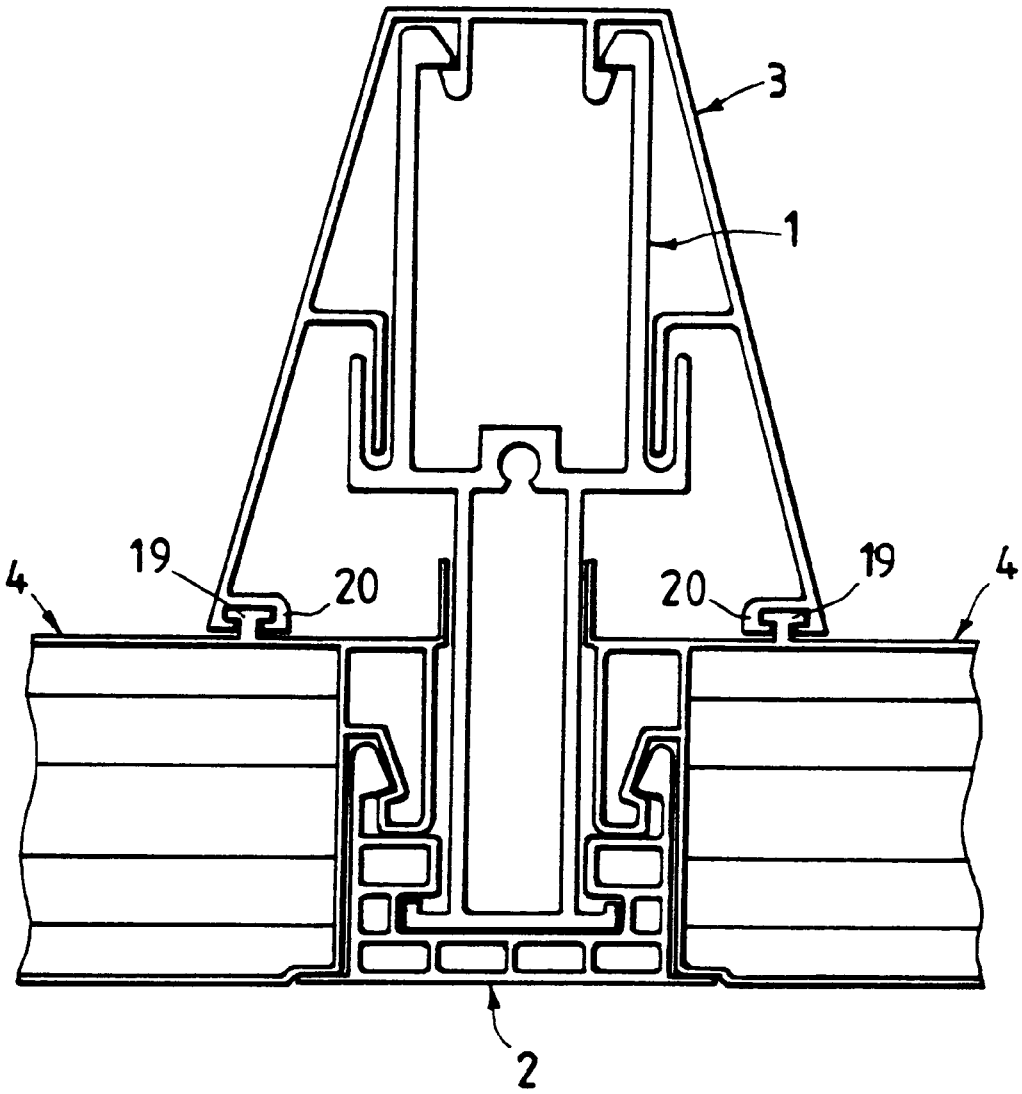

For a better understanding of the invention one embodiment will now be described, by way of example, with reference to the accompanying drawings, in which:

FIG. 1 is a cross-section of part of a roof with two panels carried by a support beam assembly, FIG. 2 is a cross-section of a support beam, FIG. 3 is a cross-section of a coupling member, FIG. 4 is a cross-section of a cap, FIG. 5 is a fragmentary cross-section of a panel, and FIG. 6 is a cross-section of another embodiment of the support beam assembly, in which the sides of the covering cap and the edge portions of the panels have complementary profiles.

The support assembly comprises a beam 1, a coupling member 2 and a cam 3 and it carries panels 4 symmetrically on opposite sides.

The beam 1 is conveniently an aluminum extrusion, symmetrical with respect to a central vertical plane, and having a slim box section 5 with its larger walls vertical forming a lower half. Along the base of this there are upwardly hooked flanges 6 projecting at each side. The upper half of the extrusion comprises upstanding limbs 7 stepped outwardly from the top of the box section 5 and with inwardly projecting ribs 8 along their top edges, while beyond the base of each limb 7 there are further outward and upturned flanges 9 forming narrow channels 10 at each side.

The coupling member 2 is another extrusion, but preferably by polycarbonate, with a multitude of box sections to make its main body stiff. This main body is generally channel-shaped but within and at the base of the channel there are undercut grooves 11 along each side. At the top of each limb of the main body there are inwardly hooked flanges 12 and on the exterior at the edges of the base, there are outwardly projecting thin plain flanges 13.

The cap 3 is a further extrusion, conveniently of PVC. It is of inverted channel shape, its side limbs splaying outwardly from the flat top. Internally, at about their mid-height, these side limbs have wings 14 projecting a short distance inwardly and then downwards, while underneath the flat top there are downwardly projecting barbs 15.

Along the lower edges of the side limbs there are narrow inturned flanges 16 against which engages sealing strips 17 extending along closely inside the edges of the panels 4. Instead of being adhered to the panels these sealing strips 17 could be attached to the flanges 16 as shown in FIG. 4 and bear on the panels 4 when the cap 3 is fitted.

An alternative cap 18 with a different sealing arrangement is shown in FIG. 6 where the panels 4 have T-section rails 19 integrally formed on their upper surfaces parallel to and a short distance away from their longitudinal edges. Instead of the plain flanges 16, there are grooves flanges 20 at the lower edges of the side limbs of the cap, complementary to the rails 19. These serve both as guides during assembly (the cap cannot be snapped on in this embodiment) and as virtually impermeable barriers against ingress of water. The panels 4 are also extrusions, preferably of polycarbonate, and they will generally be multi-walled and multi-layered. At their opposite edges which are to co-operate with respective support assemblies, each panel has downwardly and then inwardly hooked formations 18. The top of the panel continues flush with the backs of these hooks, and where they turn down there are upright flanges 19. The underside of each panel is indented at 20 along each edge below a hooked formation 18.

The assembly is put together by first sliding the coupling member 2 onto the beam 1, the flanges 6 entering the grooves 11. The beam 1 will then be secured in place, with others in parallel. The panels 4 are then lowered and pressed into place, their hooked formations 18 snapping past the hooked flanges 12. Simultaneously, the flanges 13 seat in the indentations 20. The cap 3 is then placed over the beam 1 and urged down. The wings 14 locate in the channels 10 formed by the flanges 9 as the barbs 15 snap past the ribs 8. At the same time, the sealing strips 17 engage. Should any water lying on the panels 4 get past those seals, the flanges 19 will prevent ingress into the coupling member 2.

If the cap of FIG. 6 is used, with the appropriate panels, it is slid longitudinally into position.

Instead of pressing the panels into place, it may be preferred to slide them perpendicularly to the plane of FIG. 1.

While certain materials have been suggested above as appropriate, it will be understood that alternatives could be used. But it is advantageous to have the coupling member 2 and the panels 4 of the same material with the same co-efficient of thermal expansion and with good thermal insulating properties. They need not have the same translucency and color, however, and the panels 4 may be transparent and colorless for example, while the coupling member 2, whose underside is visible, may be opaque and colored.

The beam 1 will be the main load bearer and to keep its dimensions within bounds it will probably need to be of metal, conveniently an aluminum extrusion. It will therefore conduct heat more readily than the plastics materials of the other elements. But it is completely separated by the coupling member 2 from the space below and will not be the cause of any excessive heat loss.

What is claimed is:

1. A coupling assembly comprising two substantially co-planar panels, a beam, a coupling member, and a cap, the coupling member being engageable with a first longitudinal portion of the beam to be retained thereby, adjacent edges of the panels having specialized formations distinct from a remainder of the panels, engageable with the coupling member to be retained thereby on opposite sides of the beam, and the cap being engageable with a second longitudinal portion of the beam, projecting beyond the panels, to cover said second longitudinal portion and the specialized formations of the edges of the panels.

2. A coupling assembly as claimed in claim 1, wherein the first longitudinal portion of the beam has lateral flanges or ribs which engage in complementary grooves of the coupling member.

3. A coupling assembly as claimed in claim 1, wherein the specialized formations of the panels interhook with edge portions of the coupling member.

4. A coupling assembly as claimed in claim 2, wherein the coupling member is generally channel shaped with the grooves at the base of the channel and the sides of the channel terminating in hooked edge formations.

5. A coupling assembly as claimed in claim 3, wherein the inerhooking of the panel edge formations with the coupling member is by snap action.

6. A coupling assembly as claimed in claim 1, wherein sealing means are interposed between the panels and edges of the cap that co-operate with the panels.

7. A coupling assembly as claimed in claim 6, wherein the sealing means comprise interengaging formations on the cap and panels enabling the cap to be fitted and removed only by being slid longitudinally.

8. A coupling assembly as claimed in claim 1, wherein the panels are multiwall extrusions of synthetic resin.

9. A coupling assembly as claimed in claim 1, wherein the coupling member is a multiwall extrusion of synthetic resin.

10. A coupling assembly as claimed in claim 8, wherein the synthetic resin is polycarbonate.

11. A coupling assembly as claimed in claim 1, wherein the cap is an extrusion of solid synthetic resin.

12. A coupling assembly as claimed in claim 11, wherein the cap is of polyvinyl chloride (PVC).

13. A coupling assembly as claimed in claim 1, wherein the beam is of metal.

14. A coupling assembly as claimed in claim 13, wherein the beam is an aluminum extrusion.

* * * * *